US006307288B1

(12) United States Patent
Chiang

(10) Patent No.: US 6,307,288 B1
(45) Date of Patent: Oct. 23, 2001

(54) MOTOR

(76) Inventor: Ching-Yuan Chiang, No. 50, Lane 207, Tai-Ping. W. Rd, Ping-Chen City, Taoyuan Hsien (TW)

( * ) Notice: Subject to any disclaimer, the term of this patent is extended or adjusted under 35 U.S.C. 154(b) by 0 days.

(21) Appl. No.: 09/593,138

(22) Filed: Jun. 14, 2000

(51) Int. Cl.[7] ..... H02K 9/00
(52) U.S. Cl. ..... 310/62
(58) Field of Search ..... 310/61, 62, 52, 310/53, 63; 417/366; 416/197 R

(56) References Cited

U.S. PATENT DOCUMENTS 2,993,449 * 7/1961 Harland ..... 310/62
4,212,601 * 7/1980 Ina ..... 417/365

* cited by examiner

*Primary Examiner*—Nestor Ramirez
*Assistant Examiner*—Karen Addison
(74) *Attorney, Agent, or Firm*—Dougherty & Troxell

(57) ABSTRACT

A motor has a shaft with a lengthwise through hole in a center, and a guider of a semi-circular shape having plural helical leaves to increase sucking force for gas or liquid, strengthening sucking smoothness. Water current flowing through the water passageway performs heat-dispersing function when the motor operates so as to prolong the service life of the motor. A pressure-dividing ball is placed in front of the guider to divide strong current pressure into several small current pressures to be sucked by the motor to avoid turbulent current and cause idle rotation of the motor to be damaged. Then the motor surely has strong sucking force, smoothness of flowing and its service life effectively prolonged.

8 Claims, 6 Drawing Sheets

MOTOR

BACKGROUND OF THE INVENTION

This invention relates to a motor, particularly to one having increased sucking force and enhancing smoothness of sucking and guiding and its service life.

A conventional motor shown in FIG. 1 is used for sucking in gas or liquid, including an outer housing 10 and a bottom cap 11 containing the components of the motor between them. The outer housing 10 has a water outlet 100 extending out from a rear end, and the bottom cap 11 has many small water inlets 111 in the bottom. The motor 1 includes an inner housing 12 and a base 13 for positioning other components between them. A starter 14 is fixed behind the inner housing 12 to transmit power to the motor 1, which further includes a stator 15 positioned in the inner housing 12 and the base 13 to produce electromagnetic induction, and a rotor 16 positioned in a center hollow of the stator 15 to be rotated by the electromagnetic induction produced by the stator 15. The rotor 16 has a shaft 161 extending forward from the rotor 16 and passing through the center of the base 13 outward. The shaft 161 has threads 162 formed in a front end. Further, the motor 1 has a guider 17 fixed on the front end of the shaft 161 with a nut 171 engaging the threads 162.

The operating principle of the conventional motor utilizes the starter 14 to transmit electric current to the stator in the inner housing 12 and the base 13 so that the stator may produce electromagnetic induction to rotate the rotor 16 and the shaft 161 and then the guider 17 to produce sucking force for gas or liquid entering the water inlet 111 and guided by the outer housing 10 to flow out of the water outlet 100.

As understood from the aforesaid description, the conventional motor has the following disadvantages.

(1) The load for the motor is increased as there is a bent flowing passageway between the outer housing and the motor body when gas or liquid flows through sucked by the guider.

(2) High temperature produced by the motor cannot be exhausted out as it is contained in the outer housing, nor carried away by the sucked gas or liquid, shortening the service life of the motor and easily causing the components getting out of order.

The water inlet consists of many small holes, which are liable to be clogged in gas or liquid flowing, and the dimensions for sucking is too small to have good effect.

SUMMARY OF THE INVENTION

The objective of the invention is to offer a motor having a strong sucking force, increasing smoothness of flowing of gas or liquid and prolonging the service life of the motor.

The feature of the invention is a rotor having a center lengthwise water passageway and positioned in a stator, so when the stator rotates the rotor, a guider having plural helical leaves in its interior also rotates to produce sucking force for gas or liquid current. And a pressure-dividing ball is additionally placed at a front end of the guider divides strong pressure of gas or liquid current into several small pressures so as to strengthen flowing smoothness of sucked gas or liquid current. And the rotor can carry away heat produced in operating of the motor by means of flowing gas or liquid current through the water passageway in the rotor and the shaft, effectively prolonging the service life of the motor.

BRIEF DESCRIPTION OF DRAWINGS

This invention will be better understood by referring to the accompanying drawings, wherein.

DETAILED DESCRIPTION OF THE INVENTION

Figure 1:
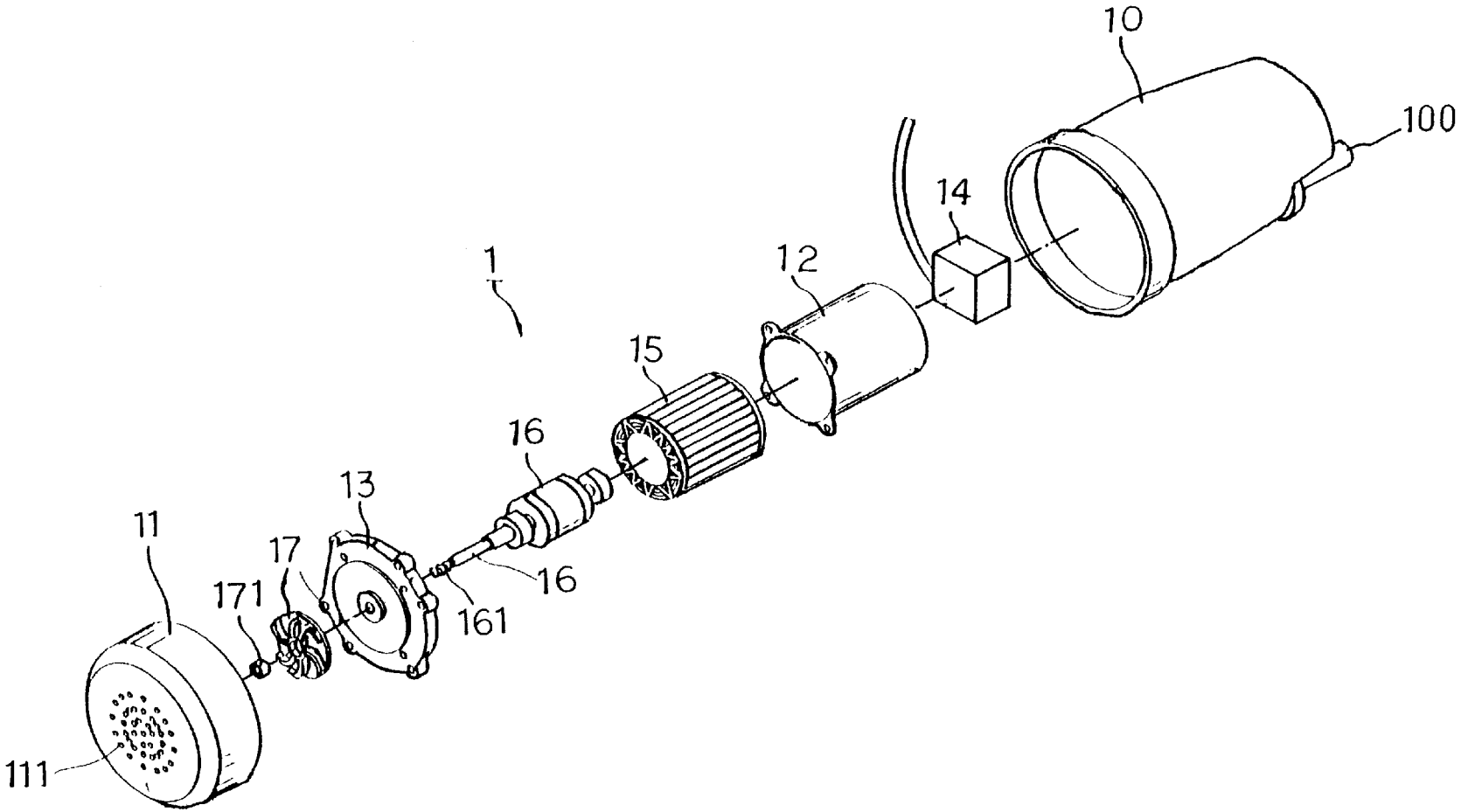
FIG. 1 is an exploded perspective view of a conventional motor.
Figure 2:
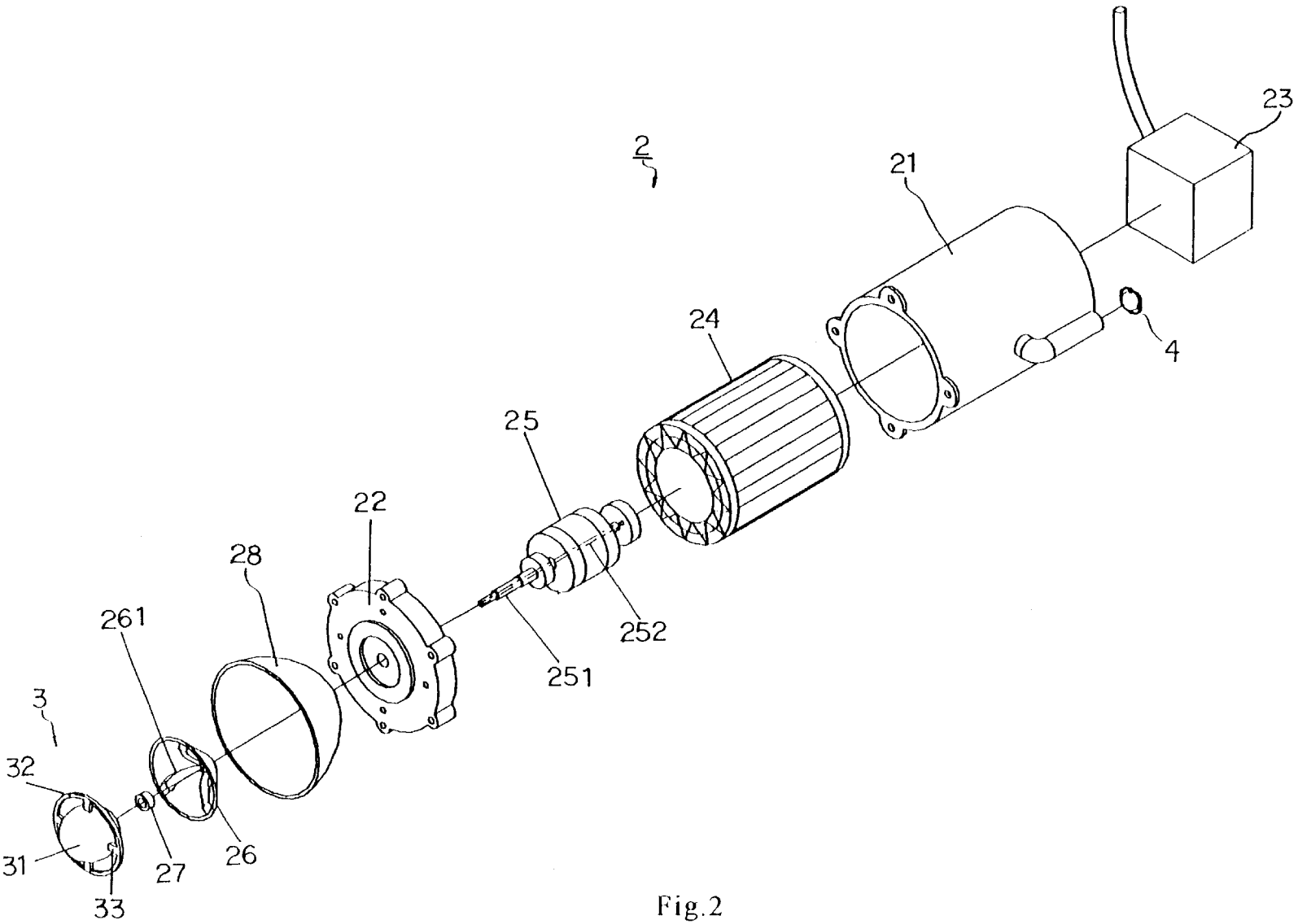
FIG. 2 is an exploded perspective view of a motor in the present invention.
Figure 3:
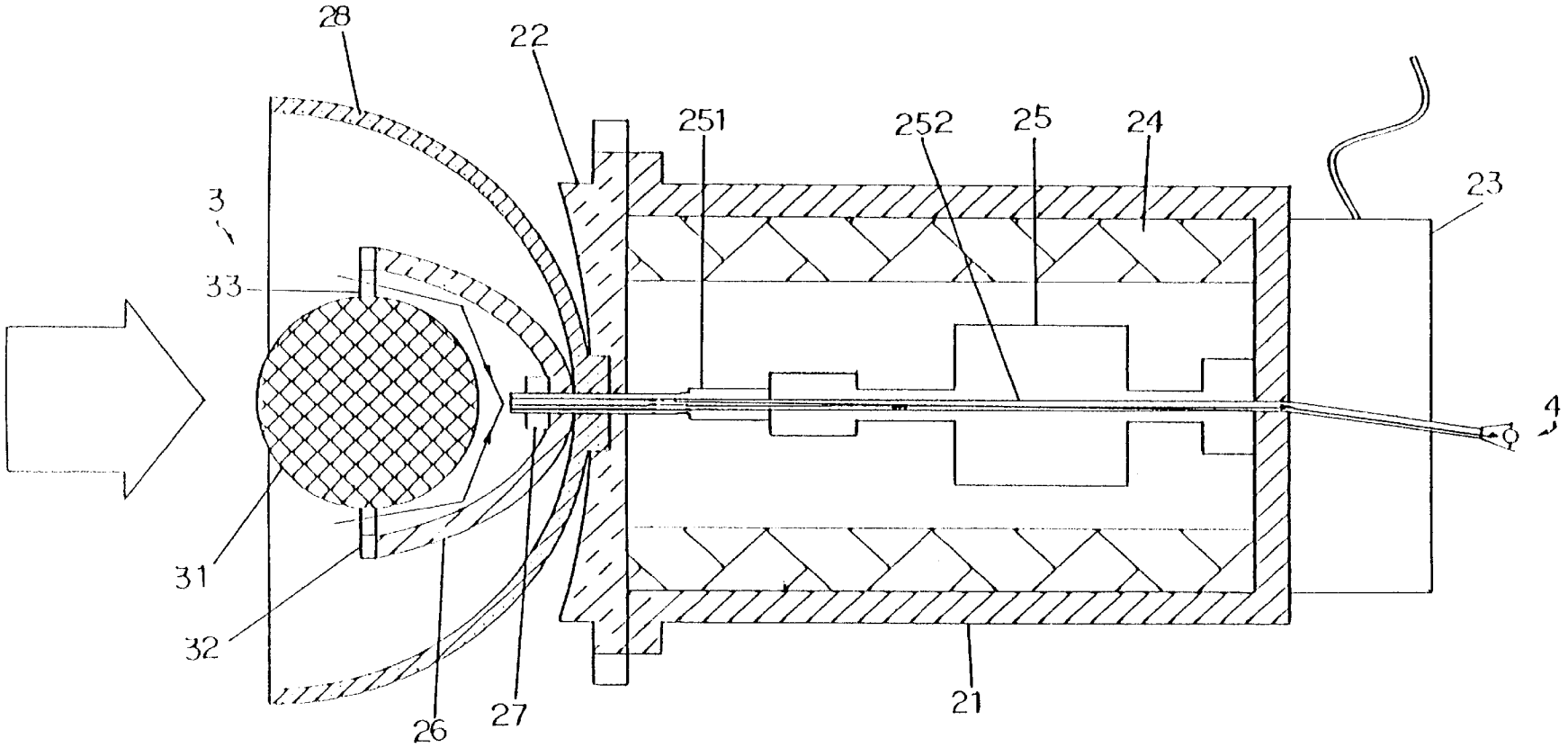
FIG. 3 is a cross-sectional view of the motor in the present invention.

A preferred embodiment of a motor 2 in the present invention, as shown in FIGS. 2 and 3, includes a housing 21, a bottom cap 22, a starter 23, a stator 24, a rotor 25, a guiding sucker 26, a current guider 28, and a pressure-dividing ball 3 as main components.

The housing 21 and the bottom cap 22 are combined together to form a hollow space for containing other components.

The starter 23 is fixed on a rear end of the housing 21, transmitting power to the stator 24 to operate.

The stator 24 is positioned in the housing 21, producing electromagnetic induction when powered by the starter 23.

The rotor 25 is positioned in a center hollow in the stator 24, rotated by the electromagnetic induction produced by the stator 24. A shaft 251 is connected to the rotor 25 to extend forward to pass through a center hole of the bottom cap 22 outward, synchronously rotating together with the rotor 25. In addition, a water passageway 252 is formed through the center of the rotor 25 and the shaft 251 for water to flow through.

The guider 26 has a hollow cone shape, connected to the end of the shaft 251, having plural helical guide leaves 261, fixed with the end of the shaft 251 with a ring 27 or by means of welding process. Then the guider 26 rotates synchronously with the rotor 25 and the shaft 251, permitting the guiding leaves 261 rotate and produce sucking force to gas or liquid.

The current guide cover 28 is shaped as a half-ball, contacting the outer center of the bottom cap 22, containing the guider 26 in its interior, producing guiding function in its interior by its half-ball shape, and at the same time expanding sucking dimensions. The pressure-dividing ball 3 has a ball body 31, and an annular ring 32 fixed around the ball body 31 with four ribs 33 spaced apart and preferably forming a cross to connect the ball body 31 with the ring 32. But other connecting methods such as welding, screws can be used, and the most preferable method is integration. Then the pressure-dividing ball is positioned to rest on the water inlet of the guider 26.

When the motor in the invention is powered by the starter 23, the stator 24 produces electromagnetic induction to rotate the rotor 25 and the shaft 251 and the guider 26, which has the guiding leaves 261 rotating to produce sucking force to suck gas or liquid in to flow toward the water inlet. Then part of the gas or liquid may flow along the curved surface of the current guide cover 28 to move to the water inlet of the guider 26. Strong gas or liquid sucked in will flow along the spherical surface of the ball body 31 in some small pressure currents, permitting the guider 26 suck gas or liquid smoothly, increasing sucking efficiency of the guider 26, and also preventing strong gas or liquid pressure from producing turbulent current to let the motor rotate idle, and effectively postponing the service life of the motor.

Gas or liquid current then flow through the water passageway 252 of the rotor 25 and the shaft 251, exchanging heat with the rotor 25 to carry away heat produced by operation of the motor, attaining heat dispersing effect. Then gas or liquid current is exhausted out of the water outlet of the housing 21. In addition, a second pressure-dividing ball 4 having the same function as the first one may be provided at the water outlet so as to increase exhausting effect of gas or liquid current.

Figure 4:
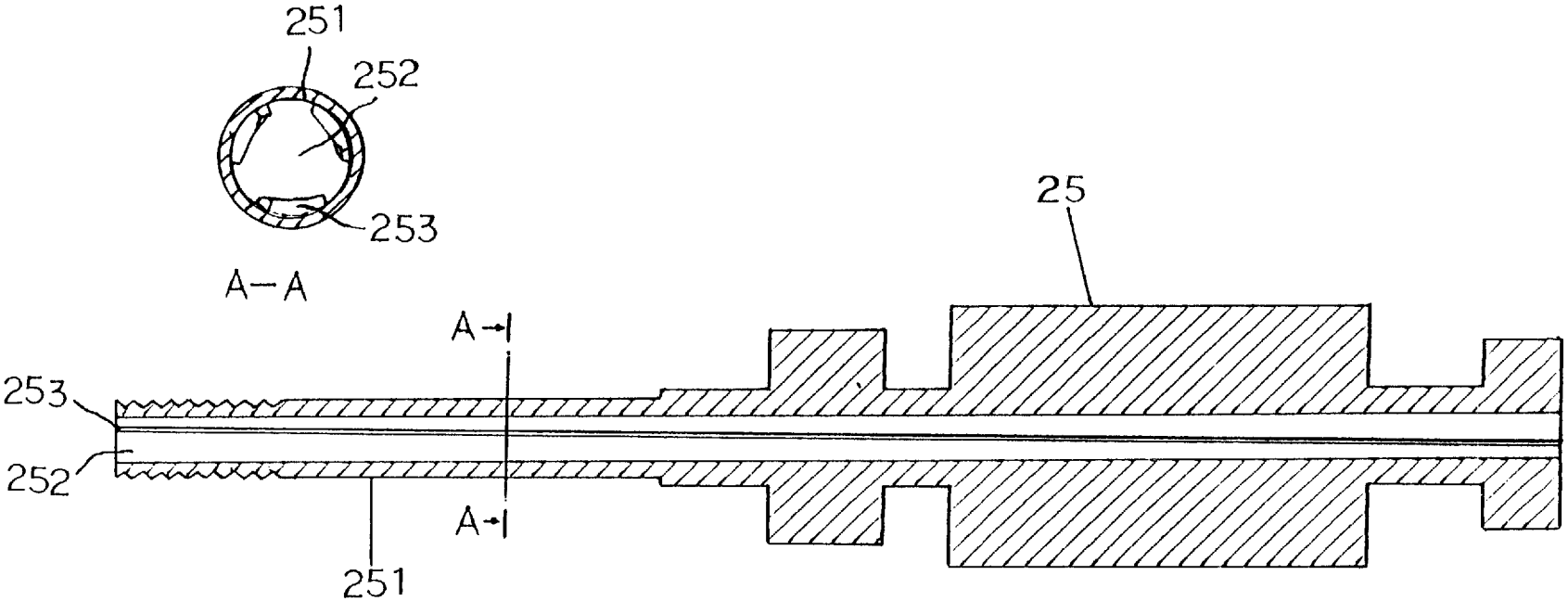
FIG. 4 is a cross-sectional view of a rotor and a shaft in the present invention.
Figure 5:
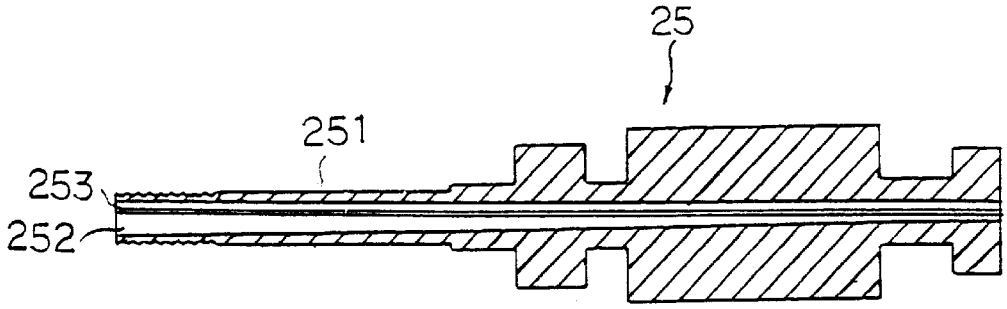
FIG. 5 is another cross-sectional view of the rotor and the shaft in the present invention.
Figure 6:
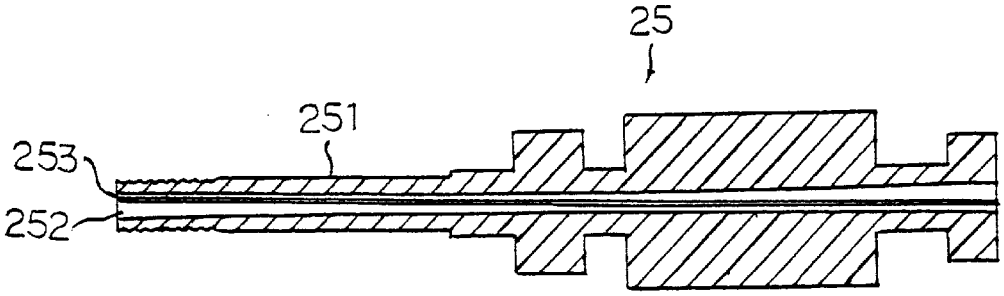
FIG. 6 is one more cross-sectional view of the rotor and the shaft in the present invention: and, FIG. 7 is a perspective view of a check valve in the present invention.

In order to augment flowing speed of gas or liquid current, the rotor 25 and the shaft 251 shown in FIGS. 4, 5 and 6, a helical guiding strip 253 may be provided in the water passageway 252, rotating synchronously with the rotor 25 and the shaft 251 when they rotate, and assisting gas or liquid current to flow more quickly to the water outlet, enhancing the effect of the motor.

If gas or liquid current is wanted to increase to elevate efficiency, the water passageway 252 may be formed to taper from the inlet to the outlet. Or the water passageway 252 may be formed to have the two ends wider than the rest portion, and then sucked-in volume and exhausted-out volume can be augmented to enhance the effect of the motor.

Figure 7:
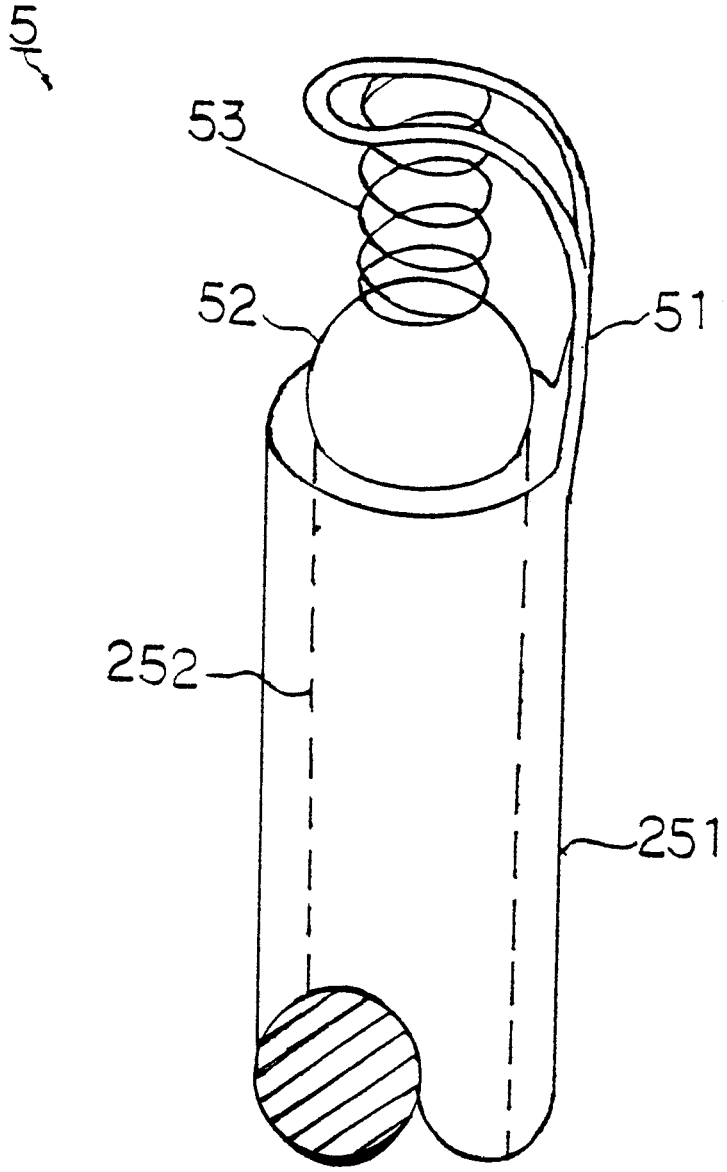

Next, the check valve 5 shown in FIG. 7 is located at the water outlet of the water passageway 252 in the rotor 25, preventing gas or liquid current reversely flow back into the water outlet. The check valve 5 includes a hamper ball 52 hampering the outlet of the water passageway 252, a position frame 51 rests against the mouth of the water outlet to support the hamper ball 51 always hampering the outlet properly, and a coil spring 53 placed between an upper end of the position frame 51 and an upper end of the hamper ball 52 to control opening and closing of the water outlet.

When liquid current flows out of the water passageway 252 to press the coil spring 53 to shrink, the water outlet will be opened, but if the exterior pressure of the water outlet is larger than the pressure of the liquid current in the passageway 252, the coil spring 53 presses the hamper ball to close up the water outlet to prevent the liquid from reversely flowing into the outlet.

As understood from the above description, the motor in the invention has a structure breaking through disadvantages of the conventional motor, having the following advantages.

(1) It includes the guider of a cone shape to produce whirlpool-like inward sucking force toward gas or liquid current, and passing through the water passageway in the shaft and rotor with increased sucking and pressure, letting the gas or liquid current produce strong flowing force, increasing doubly the sucking of the motor and exhausting effect.

(2) Flowing liquid can flow through swiftly the water passageway, as the water passageway has no bending or winding, surely never producing turbulent current to hamper flowing, in line with the helical leaves in the water passageway, permitting gas or liquid current produce strong flowing force, increasing sucking and exhausting force of the motor.

(3) The pressure-dividing ball and the current guide cover placed at the water inlet regulates and expands sucking dimensions, and dividing the strong pressure of gas or liquid current into several small pressure currents, helpful to be sucked in by the guider, increasing smoothness of sucking by the motor, permitting the motor not rotate idle to break, prolonging the service life of the motor. In addition, a second pressure-dividing ball may be placed at the water outlet to increase smoothness of exhausting out of the liquid current.

(4) Flowing of gas or liquid current through the passageway formed in the shaft and the rotor enables heat exchange performed between the gas or liquid current and the shaft and the rotor, carrying away the heat produced during operation of the rotor, dispersing the heat, and thus reducing chances of damage of the motor and postpone its service life.

While the preferred embodiment of the invention has been described above, it will be recognized and understood that various modifications may be made therein the appended claims are intended to cover all such modifications that may fall within the spirit and scope of the invention.

What is claimed is:

1. A motor capable of sucking in and guiding gas or liquid, comprising:

a housing having an interior;

a bottom cap combined with an end of said housing;

a starter fixed on a rear end of the housing to transmit power to a component in said housing;

a stator positioned in said housing and producing electromagnetic induction when powered;

a rotor positioned in an inner hollow of said stator and rotated by said starter when said stator produces electromagnetic induction, the rotor having a water passageway through a center lengthwise portion, and a shaft connected to a central end and extending outwardly through a center hole in said bottom cap;

a guider connected to a front end of said shaft, having plural helical guiding leaves in its interior, the guider secured with the front end of said shaft outside of said bottom cap with a ring; and a pressure-dividing ball is additionally placed at a front inlet of said guider for dividing a strong pressure liquid] current.

2. The motor as claimed in claim 1, wherein a current guide cover is additionally connected to an outer side of said guider, for regulating and expanding sucking dimensions of gas or liquid current.

3. The motor as claimed in claim 1, wherein a second pressure-dividing ball is additionally placed at an outlet of gas or liquid current, to order to increase exhausting effect of the outlet.

4. The motor as claimed in claim 1, wherein second plural helical leaves are additionally placed through in said water passageway.

5. The motor as claimed in claim 1, wherein said water passageway in said rotor is tapered.

6. The motor as claimed in claim 1, wherein said water passageway has two ends wider than a narrow center portion.

7. The motor as claimed in claim 1, wherein a check-valve is additionally placed at an outlet of flowing current.

8. The motor as claimed in claim 1, wherein said pressure-dividing ball is connected to a second ring around said ball by means of plural ribs.

* * * * *